US010018039B2

(12) United States Patent
Zhou

(10) Patent No.: US 10,018,039 B2
(45) Date of Patent: Jul. 10, 2018

(54) FAST-SETTING RETRIEVABLE SLIM-HOLE TEST PACKER AND METHOD OF USE

(71) Applicant: Saudi Arabian Oil Company, Dhahran (SA)

(72) Inventor: Shaohua Zhou, Dhahran Hills (SA)

(73) Assignee: Saudi Arabian Oil Company, Dhahran (SA)

( * ) Notice: Subject to any disclaimer, the term of this patent is extended or adjusted under 35 U.S.C. 154(b) by 316 days.

(21) Appl. No.: 14/853,061

(22) Filed: Sep. 14, 2015

(65) Prior Publication Data

US 2016/0084079 A1 Mar. 24, 2016

Related U.S. Application Data

(60) Provisional application No. 62/052,644, filed on Sep. 19, 2014.

(51) Int. Cl.

| | |
|---|---|
| ***E21B 33/128*** | (2006.01) |
| ***E21B 34/14*** | (2006.01) |
| ***E21B 49/08*** | (2006.01) |
| ***E21B 34/10*** | (2006.01) |
| *E21B 34/00* | (2006.01) |

(52) U.S. Cl.

CPC ..... *E21B 49/081* (2013.01); *E21B 33/1285* (2013.01); *E21B 34/10* (2013.01); *E21B 34/14* (2013.01); *E21B 49/08* (2013.01); *E21B 49/087* (2013.01); *E21B 2034/007* (2013.01)

(58) Field of Classification Search

CPC ..... E21B 33/1285; E21B 34/10; E21B 34/14; E21B 49/08; E21B 49/081; E21B 49/087

See application file for complete search history.

(56) References Cited

U.S. PATENT DOCUMENTS

| | | | |
|---|---|---|---|
| 3,662,825 | A | 5/1972 | Nutter |
| 4,580,632 | A | 4/1986 | Reardon |

(Continued)

FOREIGN PATENT DOCUMENTS

| | | | |
|---|---|---|---|
| CN | 2537815 | | 2/2003 |
| GB | 1420485 | A | 1/1976 |
| NL | 8603235 | A | 4/1987 |

OTHER PUBLICATIONS

International Search Report and Written Opinion PCT/US2015/050470 dated Dec. 15, 2015.

*Primary Examiner* — Matthew R Buck

(74) *Attorney, Agent, or Firm* — Bracewell LLP; Constance Gall Rhebergen; Linda L. Morgan

(57) ABSTRACT

A well test assembly sized for use in a slim-hole of a subterranean well includes an inner moveable sleeve having an inner circulation port and an inner fluid passage port. An outer housing has a first outer circulation port, an outer fluid passage port, and a second outer circulation port. A middle sleeve has: a middle circulation port aligned with the inner circulation port and the first outer circulation port when the assembly is in a lowering position; a middle fluid passage aligned with the inner fluid passage port and the outer fluid passage port when the assembly is in a collection position; and a fluid injection port aligned with the second outer circulation port when the assembly is in a retrieval position. A packer assembly seals an annulus between the middle sleeve and an inner diameter of the slim-hole when the assembly is in a setting position.

19 Claims, 5 Drawing Sheets

(56) References Cited

U.S. PATENT DOCUMENTS

| | | | | |
|---|---|---|---|---|
| 4,721,157 | A | 1/1988 | Berzin | |
| 5,807,082 | A | 9/1998 | Skinner et al. | |
| 5,813,460 | A | 9/1998 | Ringgenberg et al. | |
| 6,253,861 | B1 * | 7/2001 | Carmichael | E21B 21/103 175/237 |
| 6,378,612 | B1 * | 4/2002 | Churchill | E21B 21/103 166/319 |
| 6,609,569 | B2 | 8/2003 | Howlett et al. | |
| 8,844,634 | B2 | 9/2014 | Clausen et al. | |
| 9,328,579 | B2 * | 5/2016 | Wilson | E21B 21/103 |
| 2002/0100585 | A1 | 8/2002 | Spiers et al. | |

* cited by examiner

FAST-SETTING RETRIEVABLE SLIM-HOLE TEST PACKER AND METHOD OF USE

CROSS REFERENCE TO RELATED APPLICATION

This application claims priority to and the benefit of: co-pending U.S. Provisional Application Ser. No. 62/052,644 filed Sep. 19, 2014, titled "Fast-Setting Retrievable Slim-Hole Test Packer And Method Of Use," the full disclosure of which is hereby incorporated herein by reference in its entirety for all purposes.

BACKGROUND OF THE INVENTION

1. Field of the Invention

The present invention relates generally to subterranean formation evaluation, and more specifically to a one trip subterranean well test assembly.

2. Description of the Related Art

Many new subterranean wells are drilled both onshore and offshore for exploration or appraisal of potential reservoirs for the purpose of continuously expanding hydrocarbon reserves. Recently more effort has been made towards exploring tight and unconventional resources. Because well testing conventionally requires a long rig static time and associated significant costs, recent practice has evolved towards rig-less well testing. In many cases, such practice requires each exploration or appraisal well to be completed with 4½" monobore tie-back before the rig is released. Later the well is tested by appropriate downhole test tools that are conveyed by a combination of coiled tubing and wireline or slickline.

Current well test practice often creates a large wellbore storage factor of up to a few thousand feet below the zonal isolation device or test packer, particularly during testing a deep target zone across a long 4½" cemented liner, because a shut-in tool is required to be run separately and generally hanged and sealed across a profile-nipple that is located either just below or above a packer, which is a fixed location once well is completed.

Traditionally well tests have been conducted inside a 7" liner for a cased hole test or inside a 8⅜" hole for a barefoot test. However to assure drilling 8⅜" hole in a deep exploration primary target zone and run and cement 7" liner requires considerably more rig time due to a bigger well casing design required from the surface and the associated extra well cost. As a result, 5⅞" open hole installed with 4½" liner has been accepted as an economical and achievable alternative for the purpose for testing multiple zones of interests. For exploration wells, running and cementing 4½" liner inside a 5⅞" hole across targeted formations is sometimes unavoidable due to the unforeseen nature of drilling exploration wells that may force down the final casing size for the primary target zone because of up-hole drilling troubles requiring a casing or liner to actually and effectively resolve the problems, even if the well has a bigger casing design from surface.

This situation becomes nevertheless more challenging when testing tight or unconventional reservoir type formations, where movable hydrocarbon, if it exists, is only able to flow into the wellbore in a very limited volume because of poor permeability in the surrounding area of the wellbore and the allowed practical test time. This could result in the inability to flow well fluids to surface, and therefore there will be no wellhead pressure during flow test. For a wellbore with large storage space, such as when dealing with compressible gases in the wellbore, the recorded downhole data during pressure build-up test in such case could be less clear or even non-conclusive. As a result, an exploration well may simply declared as a 'dry' hole or uneconomical, even though there may be a limited flow of mobile hydrocarbon that are difficult to detect and properly evaluate with current technology in use.

In some current practice of rig-less well test for exploration and appraisal effort, a well is completed with slim-hole, such as 4½" monobore tubing tie-back with cemented 4½" liner across the targeted test zones. The operator can run in the hole with a wireline perforation gun, perforate as per plan, and then pull out of the hole with the fired gun. If required, coiled tubing is rigged and run into the slim-hole of the well to perform acid stimulation, and then the coiled tubing is pulled out of the well. The well is opened for flow on a pre-set choke to pressurize a gauge tank and record return data every minute. If the well has no flow or the wellhead pressure drops to zero, coiled tubing is rigged up and run into the hole to pump nitrogen gas lift, while diverting the return fluids to the flare pit. The well is then flowed until stabilization is achieved, and then the choke size is increased. While flowing the well through a test separator, the recorded flowing parameters are recorded, such as: flowing wellhead pressure, flowing wellhead temperature, choke size, tubing casing annulus pressure, background solids and water percentages, H2S, CO2, pH, oil rate, water rate, gas rate, total gas to oil ratio, chloride content, oil gravity and gas gravity. Samples of produced gas and liquid can be collected for later analyses.

A downhole shut-in tool and gauges can be run on wireline or slickline and hung across the R profile nipple either below or above the production packer. The well can continue to flow for a while, and then be shut in electronically by the downhole shut-in tool. The final pressure build-up can be recorded by memory gauges. The downhole shut-in tool and gauges can be pulled out of the hole. Coiled tubing can be run into the well and the well can be killed with weighted fluid. A bridge plug can be lowered into the well on a wireline and set, and then pressure tested from above. These steps may be repeated for another test zone in an upper interval.

SUMMARY OF THE DISCLOSURE

Embodiments of the present disclosure provide a fast-setting retrievable slim-hole test packer for use in a 4½" liner, a key piece of currently unavailable test equipment system to quickly and effectively capture better test data in a cost and time effective manner.

Embodiments of this disclosure provide a downhole retrievable test packer that fills a current existing gap of test packer technologies by being designed for slim-hole such as a test environment inside a 4½" liner. Because the well test assembly of this disclosure does not require reservoir fluid to flow through the interior or inner bore of the well test assembly during the flow test, and the reservoir fluid flow instead occurs in the annulus between the outer diameter of the well test assembly and wellbore, there is sufficient space available within the inner bore of the well test assembly to allow a ball to be used to move the tool between operational positions to perform various functions. In addition, embodiments of this disclosure are designed such that the well may not need to be completed with 4½" tubing, resulting in more well cost savings.

Systems and methods of this disclosure provide a fast-setting packer to act as a downhole shut-in tool that can be set close to the target zone to isolate the target zone during testing to eliminate wellbore storage effect, and is also capable of collecting fluid samples from the wellbore in a downhole environment. Embodiments disclosed herein allow e-line pass-through, so that the well test assembly can be made up with a standard production logging tool string, and other regular e-line coiled tubing tools, to enable real-time data capture and transmission. The relatively simple and robust designs allow for embodiments of this disclosure to be cost effective to manufacture and could replace conventional drill stem testing, particularly in tight and unconventional reservoirs. Systems and method described herein allow for rig-less well test operation in a manner that is more time efficient than the current practice of rig-less well tests system.

By providing a fit-for-purpose well testing system and method that can capture the essential well data in a time efficient manner, and can allow for simpler well completion to further reduce well cost and drilling rig operating time, embodiments of this disclosure are particularly beneficial in tight and unconventional resource exploration, where well testing is a critical step and also a very time consuming operation in the current field practice. By coupling the well test assembly of this disclosure with currently available horizontal drilling and multi-stage fracking technology, tight and unconventional reservoirs could be better detected and later developed, hence ultimately being a useful tool for providing additional resource development for an operator.

In an embodiment of this disclosure, a well test assembly sized for use in a slim-hole of a subterranean well includes an inner moveable sleeve, the inner moveable sleeve comprising an elongated annular member having an inner circulation port and an inner fluid passage port. An outer housing is an elongated annular member that circumscribes the inner moveable sleeve. The outer housing has a first outer circulation port, an outer fluid passage port, and a second outer circulation port. A middle sleeve is located between the inner moveable sleeve and the outer housing, the inner moveable sleeve having a middle circulation port in fluid communication with the inner circulation port and the first outer circulation port when the assembly is in a lowering position. The middle sleeve also has a middle fluid passage in fluid communication with the inner fluid passage port and the outer fluid passage port when the assembly is in a collection position, and a fluid injection port in fluid communication with the second outer circulation port when the assembly is in a retrieval position. A packer assembly seals an annulus between the middle sleeve and an inner diameter of the slim-hole when the assembly is in a setting position. A fluid sample chamber is in fluid communication with the inner fluid passage port, middle fluid passage, and the outer fluid passage port when the assembly is in the collection position.

In alternate embodiments, the outer housing is axially fixed relative to a coiled tubing connector and each of the inner moveable sleeve and the middle sleeve are axially moveable relative to the coiled tubing connector. The inner moveable sleeve can have a first ball landing seat selectively engageable by a ball to move the assembly towards the collection position. The middle sleeve can include a recess area with a larger inner diameter than an inner diameter of the middle sleeve adjacent to the recess area. The recess area can be positioned to accommodate expansion of the first ball landing seat to allow the ball to move past the first ball landing seat.

In other alternate embodiments, a second ball landing seat is selectively engageable by the ball to move the assembly towards the setting position. A spring retainer pin can be selectively moved into a pin recess of the second ball landing seat and a power spring can be retained by the spring retainer pin. The power spring can engage the packer assembly when the spring retainer pin is located in the pin recess, to set the packer assembly and retain the assembly in the setting position. A shear-screw can extend radially through the outer housing and into the middle sleeve. The shear-screw can be selectively sheared to move the assembly to the retrieval position.

In an alternate embodiment of this disclosure, a method for performing a well test in a slim-hole of a subterranean well includes lowering a well test assembly into the slim-hole to a first position. The well test assembly has an inner moveable sleeve, an outer housing circumscribing the inner moveable sleeve, a middle sleeve located between the inner moveable sleeve and the outer housing, a packer assembly, and a fluid sample chamber. A ball is dropped into the well test assembly to land on a first ball landing seat of the inner moveable sleeve and the well test assembly can be pressurized with a first pressure to move the well test assembly towards a collection position, where a fluid sample is collected from the slim-hole and stored in a fluid sample chamber. The well test assembly can be pressurized with a second pressure to force the ball past the first ball landing seat to a second ball landing seat, and move the assembly towards a setting position where the packer assembly seals an annulus between the middle sleeve and an inner diameter of the slim-hole. The well test assembly can be pressurized with a fourth pressure to shear a shear-screw and apply an upward force on the well test assembly to move the assembly towards a retrieval position and to axially move the well test assembly within the subterranean well.

In alternate embodiments, before dropping the ball into the well test assembly to land on the first ball landing seat, fluid can be circulated into the well test assembly, through an inner circulation port of the inner moveable sleeve, a middle circulation port of the middle sleeve, a first outer circulation port of the outer housing, and into the slim-hole. The step of pressurizing the well test assembly with the first pressure can include moving the inner moveable sleeve so that: the fluid sample chamber is in fluid communication with an inner fluid passage port of the inner moveable sleeve, a middle fluid passage of the middle sleeve, and an outer fluid passage port of the outer housing; and the inner circulation port is moved out of fluid communication with the middle circulation port.

In other alternate embodiments, the step of pressurizing the well test assembly with a second pressure to force the ball past the first ball landing seat can include expanding the first ball landing seat radially outward into a recess area of the middle sleeve. The step of moving the assembly towards a setting position can include fast setting the packer assembly and extending packer slips into the slim-hole by releasing a stored power spring. The step of releasing the stored power spring can include pressurizing the well test assembly with a third pressure to axially displace the second ball landing seat so that a spring retainer pin enters a pin recess of the second ball landing seat, releasing the power spring. The well test assembly can be moved to a second position, and the steps above can be repeated to test the well at the second position.

In another alternate embodiment of this disclosure, a method for performing a well test in a slim-hole of a subterranean well includes lowering a well test assembly into the slim-hole on a coiled tubing to a first position. The well test assembly has an inner moveable sleeve, an outer housing circumscribing the inner moveable sleeve, a middle sleeve located between the inner moveable sleeve and the outer housing, a packer assembly, and a fluid sample chamber. A well stimulation fluid can be circulated through the well test assembly and into the slim-hole through a circulating port. The well is logged in real time with the coiled tubing. A ball is dropped into the well test assembly to land on a first ball landing seat of the inner moveable sleeve. The well test assembly is pressurized with a first pressure to move the well test assembly towards a collection position where the circulating port is closed and a fluid sample is collected from the slim-hole and stored in a fluid sample chamber. The well test assembly is pressurized with a second pressure to force the ball past the first ball landing seat to a second ball landing seat. The well test assembly is pressurized with a third pressure to set the packer assembly so that the packer assembly seals an annulus between the middle sleeve and an inner diameter of the slim-hole. The well test assembly is pressurized with a fourth pressure to shear a shear-screw and an upward force is applied on the well test assembly to axially move the well test assembly.

In an alternate embodiment, nitrogen gas can be pumped through the well test assembly and into the slim-hole to lift fluids from within the slim-hole. After setting the packer assembly, the slim-hole can be pressure tested the pressure build-up can be recorded. The step of pressurizing the well test assembly with a fourth pressure can include opening a second circulation port. After retrieving the well test assembly out of the well, a bridge plug can be set in the slim-hole to isolate the tested interval. After that the well test assembly can be deployed again in a second position and the method can be repeated to test the well at the second position.

BRIEF DESCRIPTION OF THE DRAWINGS

So that the manner in which the above-recited features, aspects and advantages of the invention, as well as others that will become apparent, are attained and can be understood in detail, a more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments or positions.

In the following discussion, numerous specific details are set forth to provide a thorough understanding of the present invention. However, it will be obvious to those skilled in the art that the present invention can be practiced without such specific details. Additionally, for the most part, details concerning well drilling, reservoir testing, well completion and the like have been omitted inasmuch as such details are not considered necessary to obtain a complete understanding of the present invention, and are considered to be within the skills of persons skilled in the relevant art.

Figure 1:
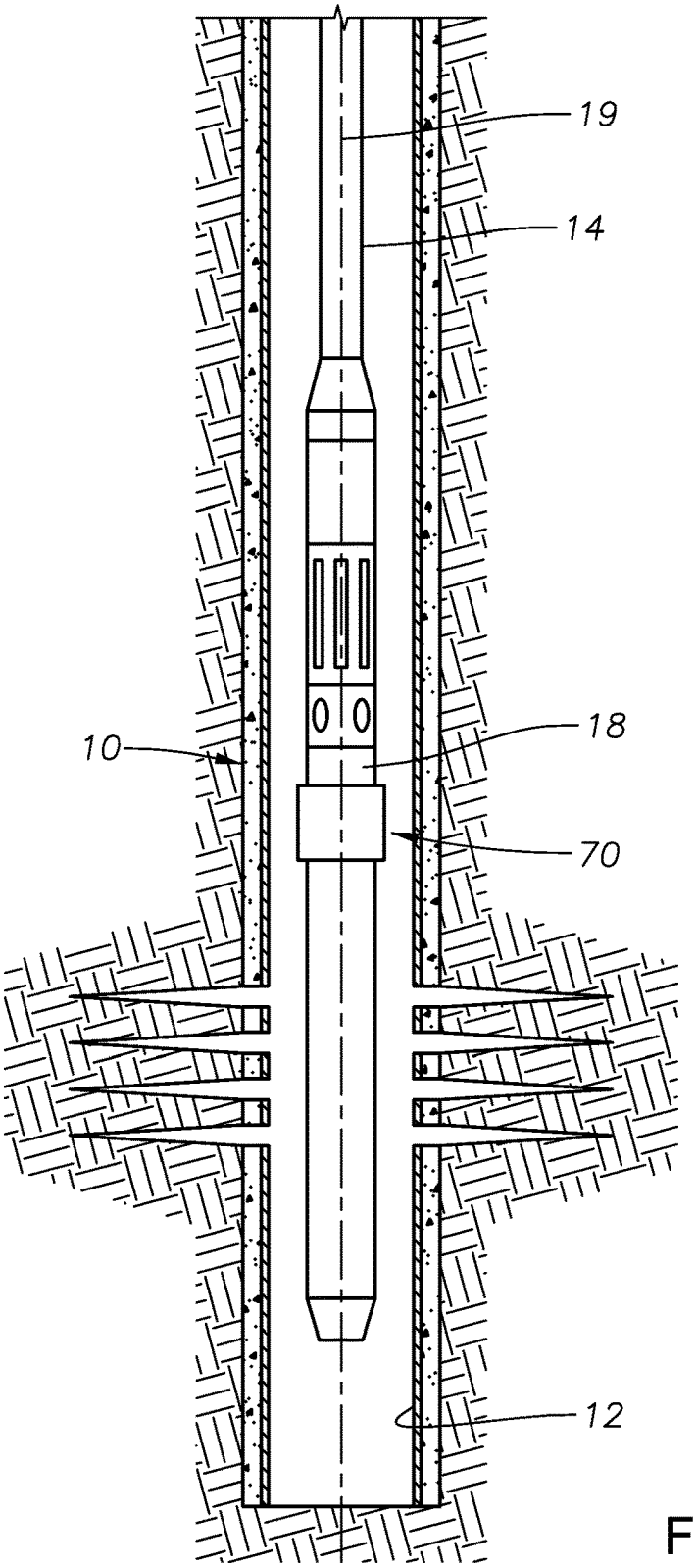
FIG. 1 is a schematic view of a production logging tool string with the well test assembly of an embodiment of this disclosure, shown lowered into a subterranean well.
Figure 2:
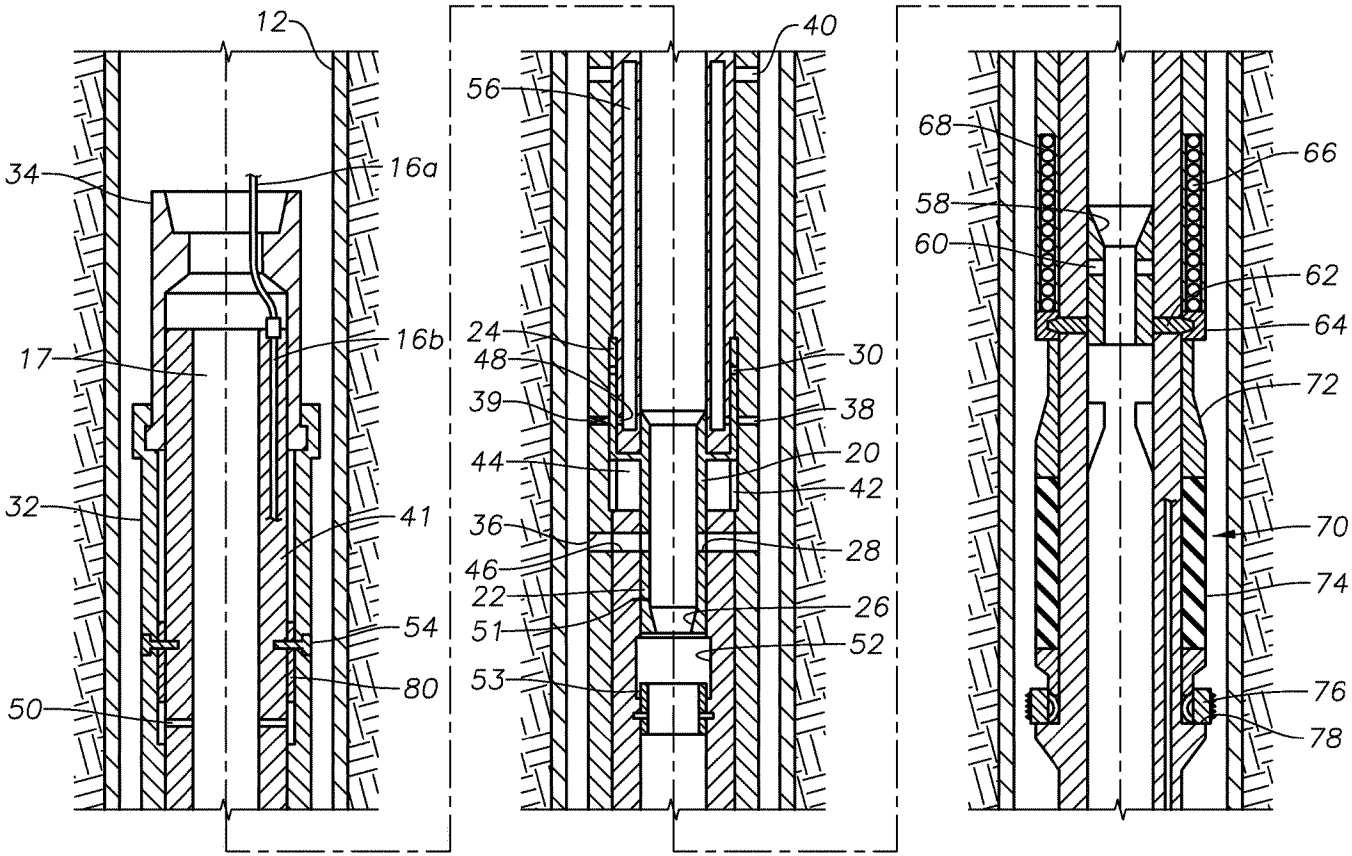
FIG. 2 is a schematic section view of the well test assembly of FIG. 1, with the well test assembly in a lowering position.
Figure 3:
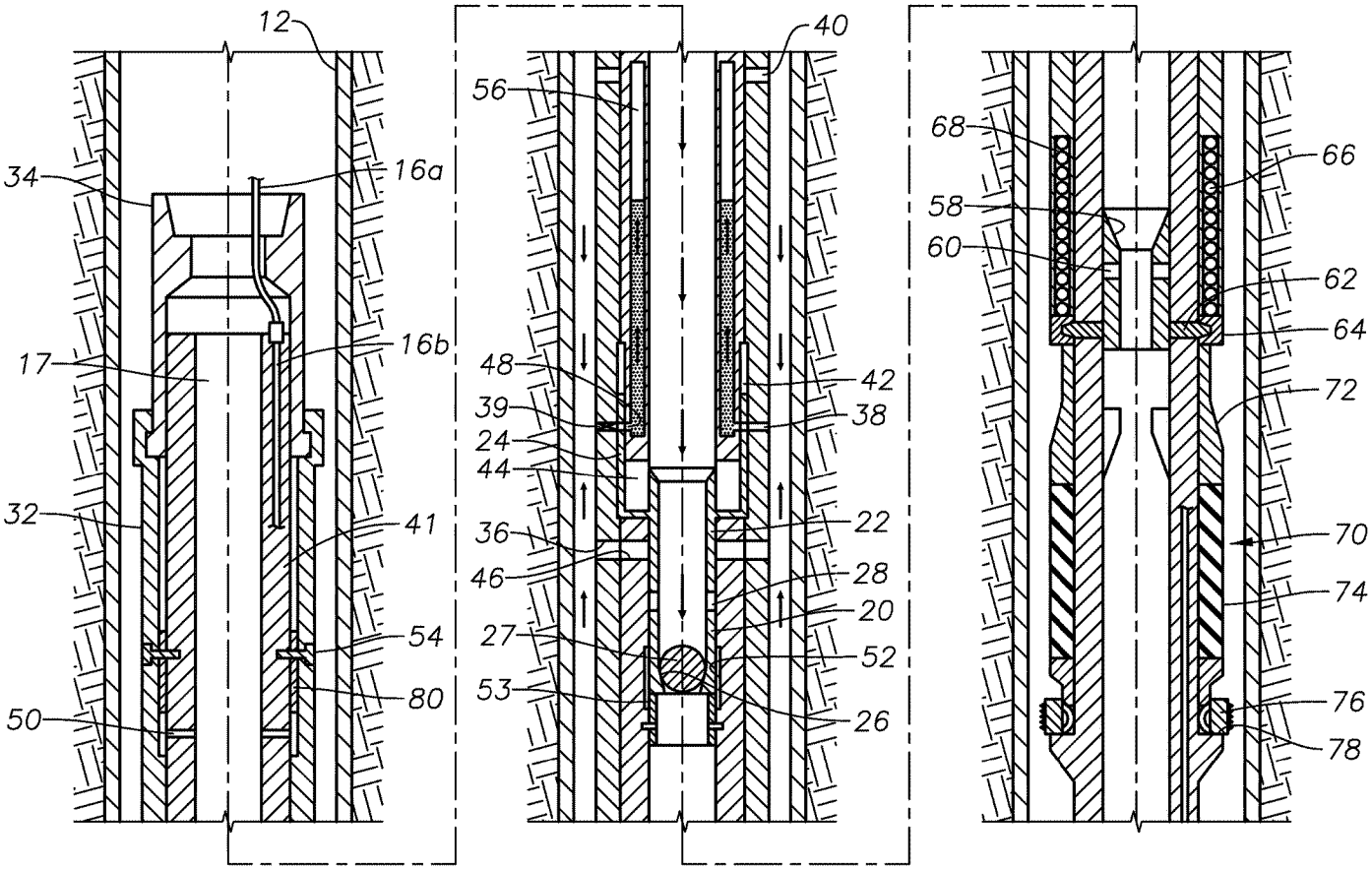
FIG. 3 is a schematic section view of the well test assembly of FIG. 1, with the well test assembly in a collection position.

Looking at FIG. 1, production logging tool 10 is shown lowered into subterranean well 12 with coiled tubing 14. Subterranean well 12 can have a slim-hole, such as section with a 4½ liner. Alternately the well can be still tested in the same way as proposed in this disclosure, except without the tie-back monobore completion with 4½" tubing string. Coiled tubing 14 can be e-line coiled tubing, which coiled tubing includes CT communications line **16*a* for transmitting and receiving information to and from production logging tool 10 by way of tool communications line 16*b* (FIGS. 2-5). Production logging tool 10 can include such modules as a battery pack, memory module, gamma ray-casing collar locator module, fluid density module, pressure and temperature module, a spinner module, a coiled tubing no-return flapper valve, a coiled tubing bottom hole assembly connector and other conventional known modules. Also included in production logging tool 10 is well test assembly 18**.

As shown in FIGS. 1-5, well test assembly 18 has an inner bore 17, central axis 19 and includes inner moveable sleeve 20. Inner moveable sleeve 20 has inner bore portion 22 which is an elongated tubular portion. Inner moveable sleeve 20 also has arm members 24 which extend radially outward and axially upward from inner bore portion 22. Arm members 24 members are separated by a distance that is greater than a diameter of inner bore portion 22. Inner moveable sleeve 20 has a first ball landing seat 26. First ball landing seat 26 has a frusto-conical shaped inner diameter and is selectively engaged by ball 27 to move well test assembly 18 towards a collection position, as will be further described below. First ball landing seat 26 is expandable in a radially outward direction to increase the inner diameter of first ball landing seat 26.

Inner moveable sleeve 20 also has inner circulation port 28. Inner moveable sleeve 20 can include one inner circulation port 28, or more than one inner circulation port 28, as shown in the in the embodiments of FIGS. 1-5. Inner circulation port 28 extends radially through a wall of inner bore portion 22 of inner moveable sleeve 20. Inner moveable sleeve 20 additionally includes one or more inner fluid passage ports 30. Inner fluid passage port 30 extends radially through a wall of arm members 24.

Well test assembly 18 additionally includes outer housing 32. Outer housing 32 is an elongated annular member circumscribing inner moveable sleeve 20 and having a greater axial length than inner moveable sleeve 20. An axially upper end of outer housing 32 is connected to coiled tubing connector 34. Coiled tubing connector 34 secures well test assembly 18 to coiled tubing 14 so that outer housing 32 is axially fixed relative to coiled tubing connector 34. Axially below coiled tubing connector 34, outer housing 32 can have a generally constant inner diameter and a generally constant outer diameter. Outer housing 32 has one or more first outer circulation ports 36, outer fluid passage ports 38, and second outer circulation ports 40. Each of the first outer circulation port 36, outer fluid passage port 38, and second outer circulation port 40 extend radially through outer housing 32. In the example of FIGS. 2-5, outer fluid passage port 38 is located axially above first outer circulation port 36, and second outer circulation port 40 is located axially above both outer fluid passage port 38 and first outer circulation port 36. A one way check valve 39 can be located within outer fluid passage port 38 so that fluid can enter fluid passage port from the slim-hole, but fluid cannot exit out of outer fluid passage port 38 into the slim-hole.

Middle sleeve 41 is located radially between inner bore portion 22 of inner moveable sleeve 20, and outer housing 32. Middle sleeve 41 is an elongated tubular member. Arm members 24 of inner moveable sleeve 20 are located radially between middle sleeve 41 and outer housing 32, in annular arm cavity 42. Annular arm cavity 42 can be defined by a groove formed in middle sleeve 41, outer housing 32, or in a combination of in middle sleeve 41 and outer housing 32. Arm members 24 extend radially through arm slots 44 of middle sleeve 41. Each of inner moveable sleeve 20 and middle sleeve 41 are axially moveable relative to coiled tubing connector 34 and relative to outer housing 32.

Middle sleeve 41 has one or more middle circulation ports 46. Each middle circulation port 46 is in fluid communication with inner circulation port 28 and first outer circulation port 36 when well test assembly 18 is in a lowering position. Middle sleeve 41 also has one or more middle fluid passages 48 that are in fluid communication with inner fluid passage port 30 and outer fluid passage port 38 when well test assembly 18 is in a collection position. Middle sleeve 41 additionally includes one or more fluid injection ports 50 in fluid communication with second outer circulation port 40 when well test assembly 18 is in a retrieval position. Each of middle circulation port 46, middle fluid passage 48, and fluid injection port 50 extend radially through a sidewall of middle sleeve 41.

When well test assembly 18 is in the lowering position, pins 51 extend from inner moveable sleeve 20 into middle sleeve 41 to retain inner moveable sleeve 20 within middle sleeve 41. Pins 51 are sheared as inner moveable sleeve 20 moves from the lowering position to the collection position. Middle sleeve 41 includes recess area 52. Recess area 52 has a larger inner diameter than an inner diameter of middle sleeve 41 adjacent to recess area 52. Recess area 52 is positioned to accommodate expansion of first ball landing seat 26 to allow ball 27 to move past first ball landing seat 26 when well test assembly 18 is in the collection position.

Stop ring 53 is retained with a retaining pin at a lower end of recess area 52. When well test assembly 18 is in the collection position, a lower end of inner moveable sleeve 20 engages a top end of stop ring 53, to prevent further downward axial movement of inner moveable sleeve 20 relative to middle sleeve 41. When well test assembly 18 is in the lowering position, collection position, and setting position, shear-screw 54 extends radially through outer housing 32 and into middle sleeve 41 to axially retain outer middle sleeve relative to outer housing 32. Shear-screw 54 is sheared to move the well test assembly 18 to the retrieval position.

Fluid sample chamber 56 is located within middle sleeve 41. Fluid sample chamber 56 is an annular cavity and is in fluid communication with inner fluid passage port 30, middle fluid passage 48, and outer fluid passage port 38 when well test assembly 18 is in the collection position. When well test assembly 18 is in the collection position, fluids from within the slim-hole of subterranean well 12 can be collected and stored within fluid sample chamber 56.

Middle sleeve 41 also houses tool communications line **16*b*. Tool communications line 16*b* extends axially through a sidewall of middle sleeve 41. A tope end of tool communications line 16*b* is located outside of middle sleeve 41 and has a connector for connecting to CT communications line 16*a* for transmitting and receiving power and information between production logging tool 10** and a surface.

Second ball landing seat 58 is located within middle sleeve 41. Second ball landing seat 58 is axially lower than first ball landing seat 26. Second ball landing seat 58 is at the top of an inner sliding sleeve which is installed with a stop ring, both of which are in contact with the inner surface of middle sleeve 41. Second ball landing seat 58 is a generally tubular member with an upward facing frusto-conical surface for engaging and retaining ball 27. Pin recess 60 is located in second ball landing seat 58.

Spring retainer pins 62 extend through openings in middle sleeve 41. A radially inner end of spring retainer pins 62 engage an outer surface of second ball landing seat 58. Spring retainer pins 62 are biased radially inward so that spring retainer pins 62 apply a radially inward force on the outer surface of second ball landing seat 58. A radially outer end of spring retainer pins 62 engage and retain spring stopper 64. Spring stopper 64 engages a lower end of power spring 66. Spring stopper 64 retains power spring 66 within spring cavity 68. Spring cavity 68 is an annular cavity located within a sidewall of outer housing 32. Spring cavity 68 is open at a bottom end of outer housing 32 and extends axially upward within the outer housing 32. When pin recess 60 is axially aligned with spring retainer pins 62, spring retainer pins 62 will move radially inward so the radially inner end of spring retainer pins 62 will move into pin recess 60 and the radially outer end of spring retainer pins 62 no longer retain spring stopper 64.

Packer assembly 70 circumscribes middle sleeve 41 and is located axially below outer housing 32. Packer assembly 70 includes energizing ring 72, annular packer 74 and packer slips 76. Packer slips 76 rest on an annular upward facing shoulder 78 on an outer diameter of middle sleeve 41. Energizing ring 72 engages spring stopper 64 so that when spring stopper 64 is no longer retained by spring retainer pins 62 and spring stopper 64 is moved axially downward by power spring 66, energizing ring 72 also moves axially downward to energize and expand annular packer 74 so that annular packer 74 seals an annulus between middle sleeve 41 and an inner diameter of the slim-hole. Downward movement of energizing ring 72 also causes packer slips 76 to extend into the slim-hole to anchor packer assembly 70 and resist relative movement between packer assembly 70 and the slim-hole. This is the setting position of well test assembly 18. The force of power spring 66 retains well test assembly 18 in the setting position.

In an example of operation, the slim-hole of subterranean well 12 can be perforated by a wireline perforating gun, or alternately, could be completed with non-cemented production liner with zonal isolation packers and valves such as sliding sleeves or rotating sleeves operated by a different tool that allows open/close of ports for fluid communication with targeted reservoir zone for testing. Well test assembly 18 can be made up with the other components of production logging tool 10. Well test assembly 18 can then be lowered into the slim-hole of subterranean well 12 on coiled tubing 14 with well test assembly 18 in the lowering position shown in FIG. 2.

Well stimulation fluids, such as acid or other stimulation chemicals, can then be pumped down coiled tubing 14 through inner bore 17 of well test assembly 18 and into the slim-hole. The well stimulation fluids will exit well test assembly through inner circulation port 28, middle circulation port 46, and first outer circulation port 36, which are in fluid communication with each other when well test assembly 18 is in a lowering position. Nitrogen gas can also be through well test assembly 18 and into the slim-hole to lift fluids from within the slim-hole. The fluids in the subterranean well can flow upward around well test assembly 18 and subterranean well 12 can be logged in real time with coiled tubing 14. During the logging process, coiled tubing 14 can be moved up or down within subterranean well 12 to identify the depths of flowing intervals and the type of fluids flowing.

Ball 27 can be dropped into the well test assembly to land on first ball landing seat 26 of inner moveable sleeve 20. Inner bore 17 of well test assembly 18 can then be pressurized with a first pressure to move inner moveable sleeve 20 axially downward relative to both middle sleeve 41 and outer housing 32 to move well test assembly 18 towards the collection position of FIG. 3. First pressure is sufficient to shear pins 51 as inner moveable sleeve 20 moves from the lowering position to the collection position. Inner moveable sleeve 20 moves axially downward until a lower end of inner moveable sleeve 20 engages a top end of stop ring 53, stopping further downward movement of inner moveable sleeve 20.

In the collection position, the circulating port defined by inner circulation port 28, middle circulation port 46, and first outer circulation port 36 is closed as inner circulation port 28 is no longer axially aligned with or in fluid communication with middle circulation port 46, and first outer circulation port 36. Downward movement of inner moveable sleeve 20 aligns inner fluid passage port 30 with middle fluid passage 48 and outer fluid passage port 38, so that inner moveable sleeve 20 aligns inner fluid passage port 30 with middle fluid passage 48 and outer fluid passage port 38 are in fluid communication with each other and with fluid sample chamber 56. A fluid sample can then be collected from the slim-hole through and outer fluid passage port 38, middle fluid passage 48, and inner fluid passage port 30 and into fluid sample chamber 56 to be stored in fluid sample chamber 56.

A second pressure can be applied to the inner bore 17 of the well test assembly 18 with sufficient pressure to force ball 27 past first ball landing seat 26 to land on second ball landing seat 58. The second pressure is higher than the first pressure and is sufficient to force ball 27 past first ball landing seat 26 by expanding first ball landing seat 26 radially outward into recess area 52 of middle sleeve 41.

Figure 4:
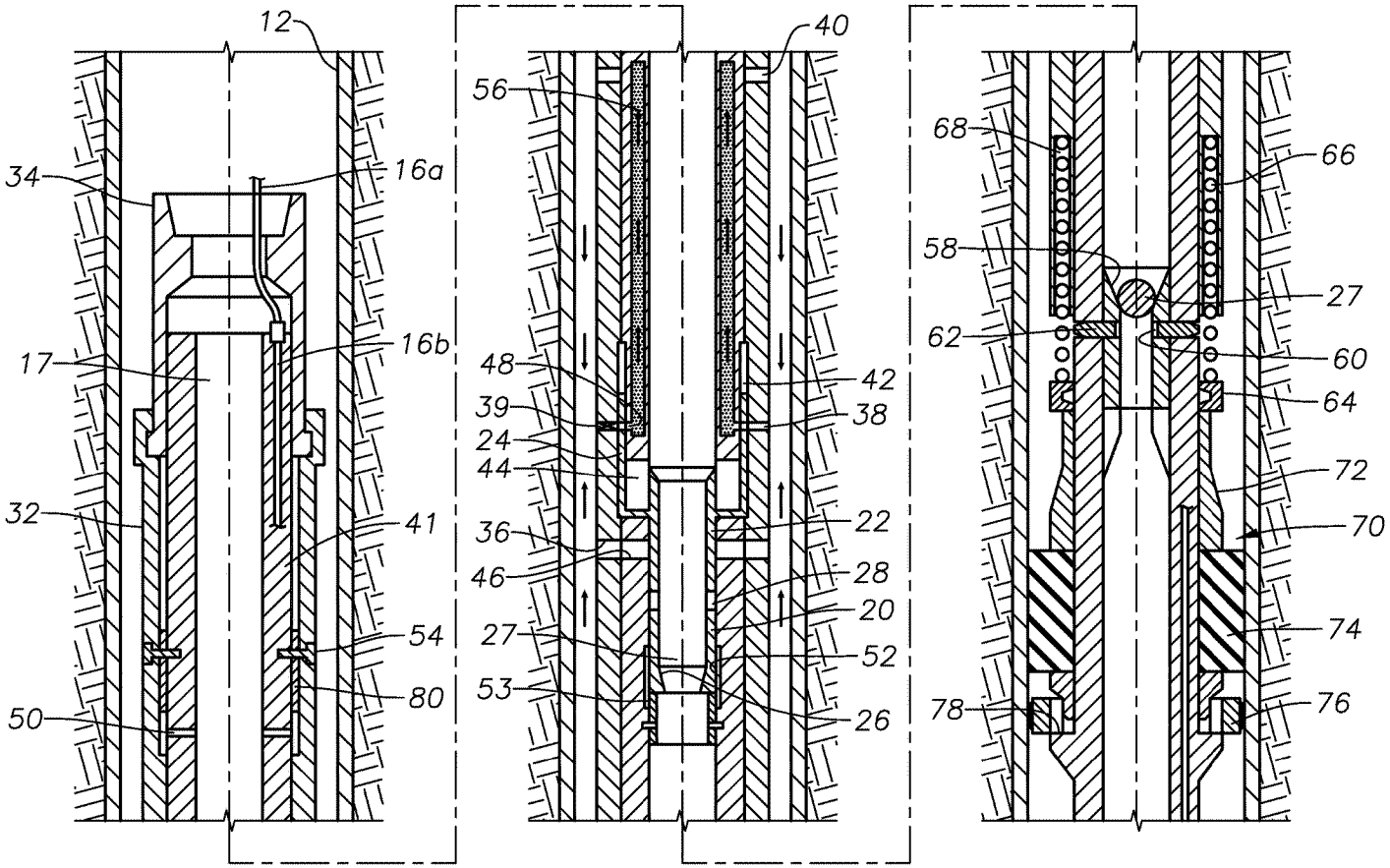
FIG. 4 is a schematic section view of the well test assembly of FIG. 1, with the well test assembly in a setting position.
Figure 5:
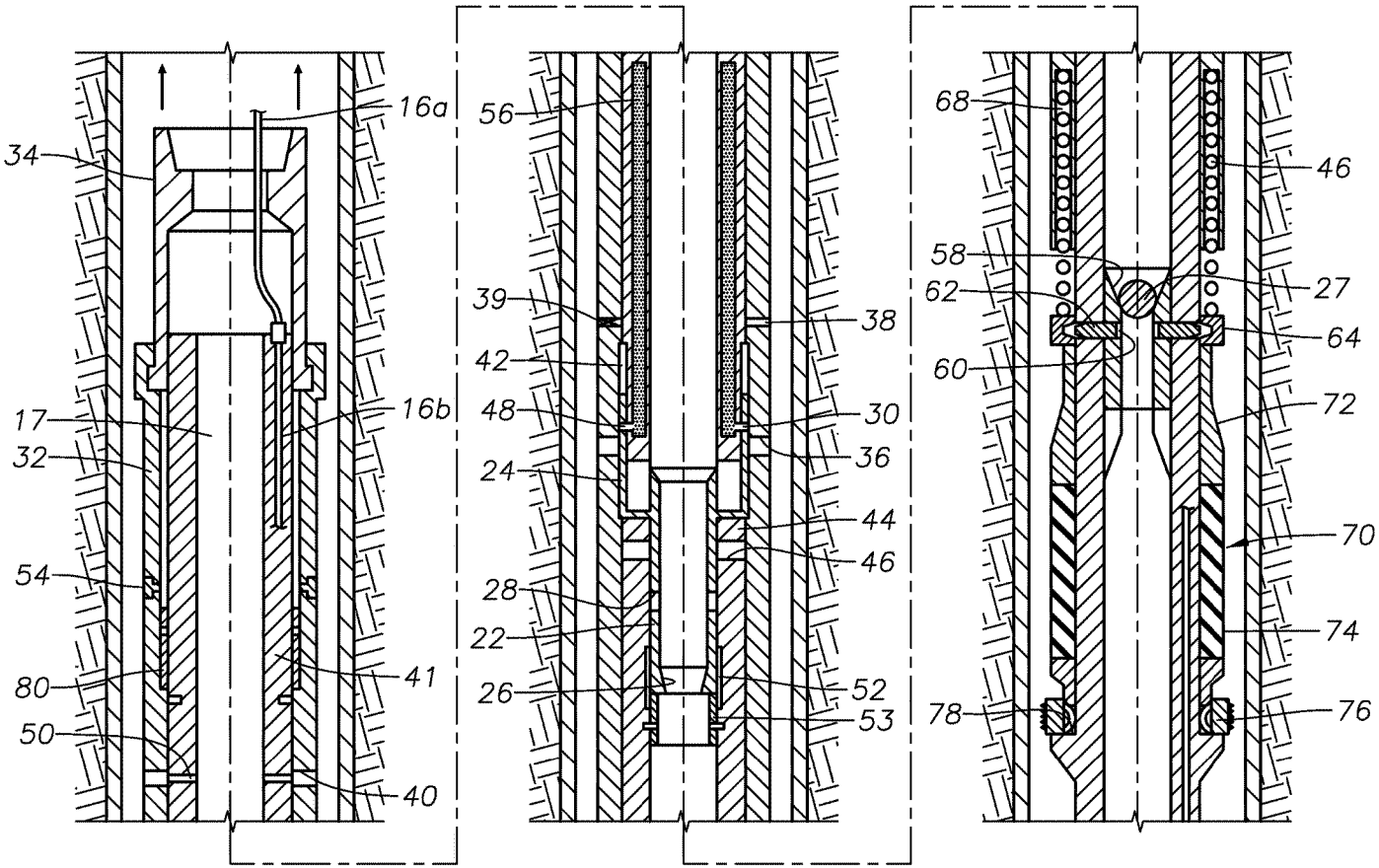
FIG. 5 is a schematic section view of the well test assembly of FIG. 1, with the well test assembly in a retrieval position.

A third pressure applied to the inner bore 17 of the well test assembly 18 can move the well test assembly 18 to the setting position of FIG. 4. The third pressure is sufficient to move second ball landing seat 58 axially downward relative to both middle sleeve 41 and outer housing 32. As second ball landing seat 58 moves downward, pin recess 60 is axially aligned with spring retainer pins 62. Spring retainer pins 62 are radially biased and will move radially inward so the radially inner end of spring retainer pins 62 is located in pin recess 60 and the radially outer end of spring retainer pins 62 no longer retain spring stopper 64. Stored power spring 66 is released and a lower end of stored power spring 66 pushes spring stopper 64 downward and packer assembly 70 is fast set. The axial force of power spring 66 energizes annular packer 74 by squeezing packer assembly 70 between spring stopper 64 and upward facing shoulder 78. This forces annular packer 74 radially outward to seal an annulus between middle sleeve 41 and an inner diameter of the slim-hole. Packer slips 76 will be forced radially outward by a lower portion of packer assembly 70 so that packer slips 76 extend into the slim-hole to anchor packer assembly 70 and resist relative movement between packer assembly 70 and the slim-hole. The slim-hole can then be pressure tested and a pressure build-up can be recorded.

A fourth pressure can be applied to the inner bore 17 of the well test assembly 18. The fourth pressure can be higher than the first pressure, the second pressure, and the third pressure. The fourth pressure is sufficient to shear shear-screw 54. The fourth pressure enters fluid injection port 50 and forces shear ring 80 axially upwards between outer housing 32 and middle sleeve 41 to shear shear-screw 54. Upward force applied to well test assembly 18 by coiled tubing 14 will move well test assembly 18 to the retrieval position of FIG. 5. In the retrieval position, outer housing 32, which is axially fixed relative to coiled tubing connector 34 will move upward relative to middle sleeve 41.

The upward relative movement of outer housing 32 will cause fluid injection port 50 to align with, and be in fluid communication with, second outer circulation port 40 to act as a second circulation port so that fluids can be circulated between the slim-hole and inner bore 17 of well test assembly 18, such as fluids for killing the well. The upward relative movement of outer housing 32 will also relieve the forces applied by power spring 66 so that packer assembly 70 will be unset. Production logging tool 10 can be retrieved from 12 subterranean well 12 by upward pulling of coiled tubing 14. A bridge plug can then be set in the slim-hole to isolate the tested interval.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A well test assembly sized for use in a slim-hole of a subterranean well, the assembly comprising:

an inner moveable sleeve, the inner moveable sleeve comprising an elongated annular member having an inner circulation port and an inner fluid passage port;

an outer housing, the outer housing comprising an elongated annular member circumscribing the inner moveable sleeve and having a first outer circulation port, an outer fluid passage port, and a second outer circulation port;

a middle sleeve located between the inner moveable sleeve and the outer housing, the middle sleeve having a middle circulation port in fluid communication with the inner circulation port and the first outer circulation port when the assembly is in a lowering position, a middle fluid passage in fluid communication with the inner fluid passage port and the outer fluid passage port when the assembly is in a collection position, and a fluid injection port in fluid communication with the second outer circulation port when the assembly is in a retrieval position;

a packer assembly circumscribing the middle sleeve and sealing an annulus between the middle sleeve and an inner diameter of the slim-hole when the assembly is in a setting position; and a fluid sample chamber located within the middle sleeve in fluid communication with the inner fluid passage port, the middle fluid passage, and the outer fluid passage port when the assembly is in the collection position.

2. The assembly according to claim 1, wherein the outer housing is axially fixed relative to a coiled tubing connector and each of the inner moveable sleeve and the middle sleeve are axially moveable relative to the coiled tubing connector.

3. The assembly according to claim 1, wherein the inner moveable sleeve has a first ball landing seat selectively engageable by a ball to move the assembly towards the collection position.

4. The assembly according to claim 3, wherein the middle sleeve includes a recess area with a larger inner diameter than an inner diameter of the middle sleeve adjacent to the recess area, the recess area positioned to accommodate expansion of the first ball landing seat to allow the ball to move past the first ball landing seat.

5. The assembly according to claim 4, further comprising a second ball landing seat located within the middle sleeve and selectively engageable by the ball to move the assembly towards the setting position.

6. The assembly according to claim 5, further comprising:

a spring retainer pin selectively moveable into a pin recess of the second ball landing seat;

a power spring retained by the spring retainer pin, the power spring engaging the packer assembly when the spring retainer pin is located in the pin recess to set the packer assembly and retain the assembly in the setting position.

7. The assembly according to claim 1, further comprising a shear-screw extending radially through the outer housing and into the middle sleeve, the shear-screw selectively sheared to move the assembly to the retrieval position.

8. A method for performing a well test in a slim-hole of a subterranean well, the method comprising:

(a) lowering a well test assembly into the slim-hole to a first position, the well test assembly having an inner moveable sleeve, an outer housing circumscribing the inner moveable sleeve, a middle sleeve located between the inner moveable sleeve and the outer housing, a packer assembly circumscribing the middle sleeve, and a fluid sample chamber located within the middle sleeve;

(b) dropping a ball into the well test assembly to land on a first ball landing seat of the inner moveable sleeve and pressurizing the well test assembly with a first pressure to move the well test assembly towards a collection position where a fluid sample is collected from the slim-hole and stored in the fluid sample chamber;

(c) pressurizing the well test assembly with a second pressure to force the ball past the first ball landing seat to a second ball landing seat located within the middle sleeve, and moving the assembly towards a setting position where the packer assembly seals an annulus between the middle sleeve and an inner diameter of the slim-hole; and (d) pressurizing the well test assembly with a fourth pressure to shear a shear-screw extending radially through the outer housing and into the middle sleeve and applying an upward force on the well test assembly to move the assembly towards a retrieval position, and to axially move the well test assembly.

9. A method according to claim 8, further comprising before dropping the ball into the well test assembly to land on the first ball landing seat, circulating fluid into the well test assembly, through an inner circulation port of the inner moveable sleeve, a middle circulation port of the middle sleeve, a first outer circulation port of the outer housing, and into the slim-hole.

10. A method according to claim 9, wherein the step of pressurizing the well test assembly with the first pressure includes moving the inner moveable sleeve so that:

the fluid sample chamber is in fluid communication with an inner fluid passage port of the inner moveable sleeve, a middle fluid passage of the middle sleeve, and an outer fluid passage port of the outer housing; and the inner circulation port is moved out of fluid communication with the middle circulation port.

11. A method according to claim 8, wherein the step of pressurizing the well test assembly with the second pressure to force the ball past the first ball landing seat includes expanding the first ball landing seat radially outward into a recess area of the middle sleeve.

12. The method according to claim 8, wherein the step of moving the well test assembly towards the setting position includes fast setting the packer assembly and extending packer slips into the slim-hole by releasing a stored power spring.

13. A method according to claim 12, wherein the step of releasing the stored power spring includes pressurizing the well test assembly with a third pressure to axially displace the second ball landing seat so that a spring retainer pin enters a pin recess of the second ball landing seat, releasing the stored power spring.

14. The method according to claim 8, further comprising moving the well test assembly to a second position, and repeating step (b)-(d).

15. A method for performing a well test in a slim-hole of a subterranean well, the method comprising:

(a) lowering a well test assembly into the slim-hole on a coiled tubing to a first position, the well test assembly having an inner moveable sleeve, an outer housing circumscribing the inner moveable sleeve, a middle sleeve located between the inner moveable sleeve and the outer housing, a packer assembly circumscribing the middle sleeve, and a fluid sample chamber located within the middle sleeve;

(b) circulating a well stimulation fluid through the well test assembly and into the slim-hole through a circulating port;

(c) logging the well in real time with the coiled tubing;

(d) dropping a ball into the well test assembly to land on a first ball landing seat of the inner moveable sleeve and pressurizing the well test assembly with a first pressure to move the well test assembly towards a collection position where the circulating port is closed and a fluid sample is collected from the slim-hole and stored in the fluid sample chamber;

(e) pressurizing the well test assembly with a second pressure to force the ball past the first ball landing seat to a second ball landing seat located within the middle sleeve;

(f) pressurizing the well test assembly with a third pressure to set the packer assembly so that the packer assembly seals an annulus between the middle sleeve and an inner diameter of the slim-hole; and (g) pressurizing the well test assembly with a fourth pressure to shear a shear-screw extending radially through the outer housing and into the middle sleeve and applying an upward force on the well test assembly to axially move the well test assembly.

16. The method according to claim 15, further comprising pumping nitrogen gas through the well test assembly and into the slim-hole to lift fluids from within the slim-hole.

17. The method according to claim 15, further comprising after setting the packer assembly, pressure testing the slim-hole and recording a pressure build-up.

18. The method according to claim 15, wherein step (g) further comprises opening a second circulation port to circulate fluids between the slim-hole and the well test assembly.

19. The method according to claim 15, further comprising after step (g), setting a bridge plug in the slim-hole.

* * * * *